United States Patent [19]

Vögele et al.

[11] Patent Number: 4,469,148

[45] Date of Patent: Sep. 4, 1984

[54] FILLING APPARATUS FOR VISCOUS PRODUCTS

[75] Inventors: Günther Vögele, Schönaich; Kuno Lemke, Bietigheim-Bissingen, both of Fed. Rep. of Germany

[73] Assignee: Robert Bosch GmbH, Stuttgart, Fed. Rep. of Germany

[21] Appl. No.: 396,185

[22] Filed: Jul. 8, 1982

[30] Foreign Application Priority Data

Aug. 1, 1981 [DE] Fed. Rep. of Germany ..... 3130537

[51] Int. Cl.[3] ..... B65B 3/04

[52] U.S. Cl. ..... 141/87; 222/108

[58] Field of Search ..... 141/67, 68, 1, 11, 46, 141/392, 86, 255, 264; 222/108, 571, 533, 547, 556, 558; 53/420; 580/285

[56] References Cited

U.S. PATENT DOCUMENTS 4,047,546 9/1977 Bassendale et al. ..... 141/87

FOREIGN PATENT DOCUMENTS 2333539 1/1975 Fed. Rep. of Germany .

2921236 4/1980 Fed. Rep. of Germany .

*Primary Examiner*—Houston S. Bell, Jr.

*Attorney, Agent, or Firm*—Edwin E. Greigg

[57] ABSTRACT

A filling apparatus for viscous products, such as those including ingredients in pieces, is proposed. In order to avoid soiling of the sealing rims of the containers, onto which a cover foil is sealed, dripping or squirting from the filler mouthpiece is to be intercepted. The apparatus has a receiving element for this purpose in the form of a scoop, which in a first position assumes a vertical position remote from the filler mouthpiece which intercepts squirting and in a second position assumes a horizontal position passing beneath the filler mouthpiece. The supporting apparatus for the scoop is embodied such that when the scoop is moved from one position into the other position, the scoop undergoes a one-quarter revolution.

8 Claims, 4 Drawing Figures

FILLING APPARATUS FOR VISCOUS PRODUCTS

BACKGROUND OF THE INVENTION

The invention is based on a filling apparatus as generally revealed hereinafter. In a filling apparatus proposed in German Offenlegungsschrift No. 23 33 539, for instance, a tubular or boxlike pouring conduit is disposed transversely below the filler mouthpiece in order to prevent dribbling after pouring. The filler mouthpiece points downward; the pouring conduit is open at one end and closed at the other, and it has an opening near the closed end, at the top in its jacket, through which the filler mouthpiece protrudes. The pouring conduit is pivotable about a horizontal axis in the vicinity of its closed end, so that the outlet at the open end is inclined obliquely upward in the position for receiving the product and is inclined obliquely downward in the position for pouring the product into a container. Although dribbling is prevented in the known apparatus, still this apparatus can be used only for pouring products of low viscosity and high flowability, such as liquids. It would be desirable, however, to have a filling apparatus for pouring portions of pasty, pulpy and lumpy products as well, such as milk products containing fruits, ready-to eat dishes, pet food and the like, into flat containers in such a way that as the containers are being conveyed onward, the sealing rims will not become soiled by droplets or by fibers caught in and suspended from the filler mouthpiece.

OBJECT AND SUMMARY OF THE PREVENTION

The filling apparatus according to the invention has the advantage that the receiving element, in one position, catches and retains suspended fibers and droplets by reason of its shovel-like embodiment, while in its other position it opens up the outlet of the filler mouthpiece so that a container can be filled directly therefrom.

In a filling apparatus having a valve push rod which is displaceable in the filler mouthpiece and has an outlet on its side which points obliquely downward, such as is known by way of example from German Offenlegungsschrift No. 29 21 236, a substantially vertical position of the scoop in its second position, which is transverse relative to the outlet of the valve push rod, makes it possible to catch any squirting streams and redirect them into the container which is ready to be filled; thus soiling of the sealing rims of the container is avoided during the pouring process as well. This advantage becomes still greater as a result of the provision that the scoop has side panels which are able to catch any streams squirting toward the side.

The invention will be better understood and further objects and advantages thereof will become more apparent from the ensuing detailed description of two preferred embodiments taken in conjunction with the drawings.

DESCRIPTION OF THE PREFERRED EMBODIMENTS

One portion 3 of a product at a time is placed by the filling apparatus into flat, dish-like packaging containers 1, the openings of which have a continuous, offstanding sealing rim 2 for securing a cover foil. The product may have a fluid or pasty consistency or may also have added pieces included, so that should some of these pieces (for example, fruit, meat and the like) become stuck in the outlet, the fluid part of the product, being under pressure, will squirt out of the outlet.

Figure 1:
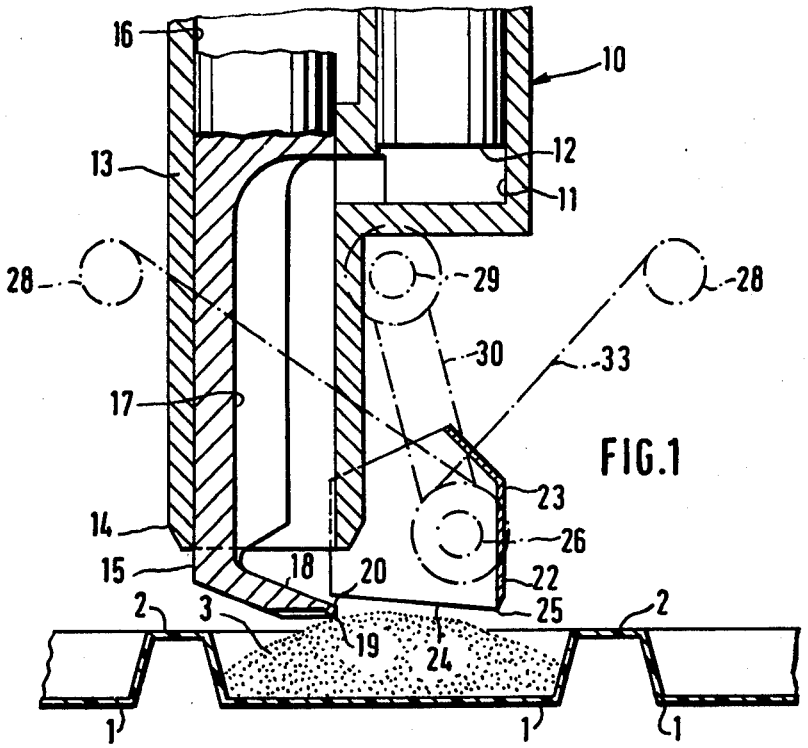
FIG. 1 shows a filling apparatus in its filling position, seen in cross section.

The filling apparatus includes a metered-dose dispenser 10 (German Offenlegungsschrift No. 29 21 236) having a dispensing cylinder 11, a dispensing piston 12 reciprocating therein, a valve housing 13 with a filler mouthpiece 14 flush therewith, and a valve push rod 15 displaceable within the filler mouthpiece 14. The valve push rod 15, which in one position connects the dispensing cylinder 11 with a supply chamber 16 and in the other position connects the dispensing cylinder 11 with the outlet of the filler mouthpiece 14, has a groove 17 milled into it at the side, which is enlarged toward the bottom and defined by an oblique bottom 18, so that in the lower position of the valve push rod 15, the lateral outlet defined by the bottom 18 and the lower rim of the filler mouthpiece 14 is directed downward obliquely with respect to the horizontal (FIG. 1). On its circumference, the bottom 18 has a dribble edge 19 on the underside and a sharp cutting edge 20 on the top.

In order to prevent droplets from the filler mouthpiece 14 from dripping onto the sealing rims 2 of the containers 1 below the filler mouth piece 14 while filled containers are being moved away and those to be filled are being brought to the filling apparatus, and in order to enable the interception of any squirting during the filling procedure, a squirt interceptor-droplet receiving element in the form of a scoop 22 is movably associated with the filler mouthpiece 14. The scoop 22 has a dish-like or groove-like bottom 23 having laterally attached panels 24. It is disposed in a movable fashion such that in the filling position (FIG. 1 and FIG. 3) it assumes a substantially vertical position in which its bottom 23 is placed transversely with respect to the stream of the product leaving the filler mouthpiece 14 and the valve push rod 15, while in the position of rest (FIG. 2 and FIG. 4) it assumes a substantially horizontal position, in which it passes freely below the filler mouthpiece 14 and comes to rest at least in the vicinity of the outlet. The rim of the bottom 23 of the scoop 22 which points downward when the apparatus is in the vertical position is embodied as a wedge-shaped drip edge 25 having a curvature at the underside.

Figure 2:
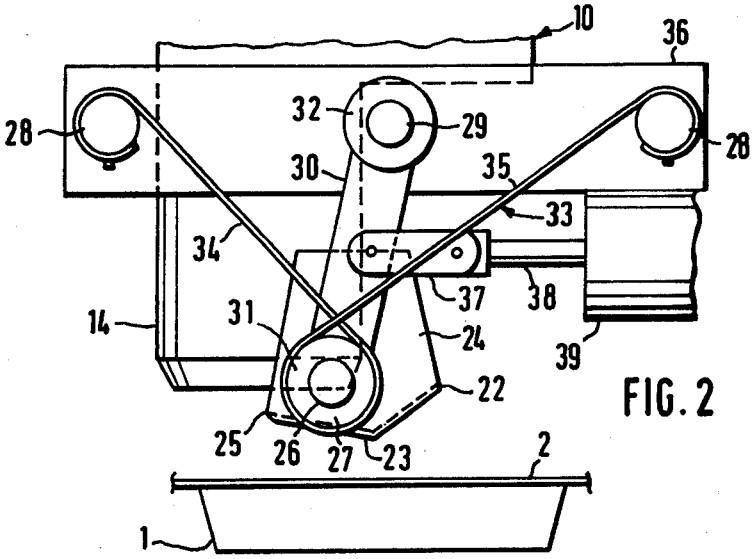
FIG. 2 is a lateral view of the filling apparatus in its position of rest.

In order to execute a reciprocating movement away from and toward the filler mouthpiece 14 as well as a simultaneous one-quarter rotation from the vertical to the horizontal position, the scoop 22 of the exemplary embodiment shown in FIGS. 1 and 2 is rotatably supported by means of a protrusion 26, offstanding from one panel 24, in the lower eye 31 of a pivotable lever 30. Secured on the protrusion 26 next to the eye 31 is a roller 27, about which a flexible belt 33 is wound and fastened at one point; the segments 34, 35 of the belt 33 extend obliquely upward away from one another, and their ends are secured to fixed elements 28. These elements 28 as well as the protrusion 29 carrying the upper eye 32 of the lever 30 are secured on a horizontal carrier 36, which is disposed in a fixed manner on the side of the metered-dose dispenser 10. In order to transmit a pivoting movement to the crank 30, this lever is connected via a link 37 with the piston rod 38 of a pneumatic actuation cylinder 39.

For filling, one container 1 at a time is conveyed to below the filler mouthpiece 14 and the scoop 22 such that its vertical central axis is located approximately in the middle between the outlet, embodied by the filler mouthpiece 14 and by the valve push rod 15, and the scoop 22 in its vertical position. In this position, the product leaving this outlet is distributed uniformly in the container. In the filling position, the valve push rod 15 protrudes almost to the top of the container 1 (FIG. 1); depending upon the product, it is also possible for the valve push rod 15 even to dip into the container. With is bottom 23 and its side panels 24, the scoop 22, which is then in the vertical position and the width of which is somewhat less than the width of the container 1, effects shielding in the pouring direction of the sealing rims 2 of the container 1 which are located in squirting range, intercepts squirting material and redirects it downward into the container 1 via the drip edge 25. After the filling process has been completed, the valve push rod 15 is retracted into the filler mouthpiece 14. At the same time, the crank 30 is pivoted toward the filler mouthpiece 14, and the scoop is rotated in a one-quarter turn by the belt 33 out of its vertical position into the horizontal position (FIG. 2), in which it intercepts any drops dripping from the filler mouthpiece 14 and shields the container from any fibers which may be hanging from the filler mouthpiece 14.

Figure 3:
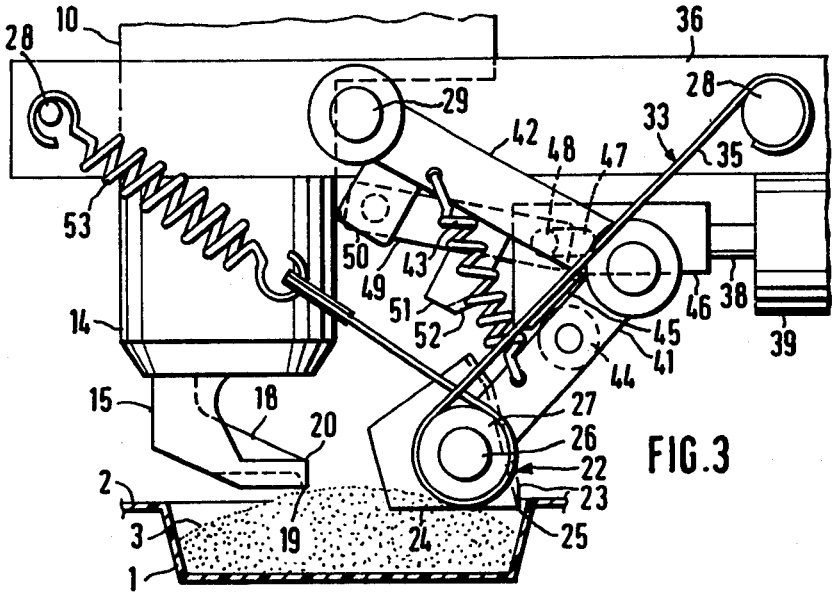
FIG. 3 is a lateral view of a second exemplary embodiment of the filling apparatus according to the invention, seen in its filling position.
Figure 4:
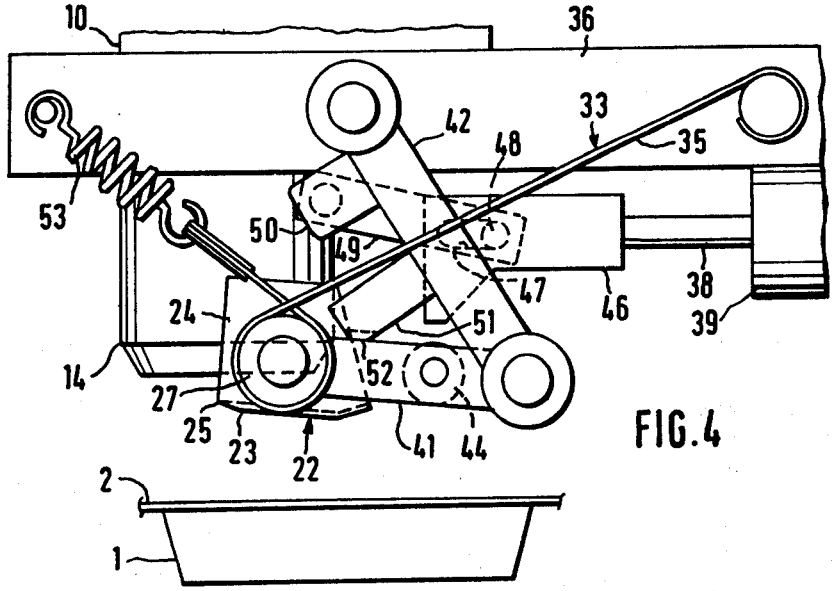
FIG. 4 is a lateral view of the filling apparatus of FIG. 3, seen in its position of rest.

In order to prevent the scoop 22, as it moves to below the filler mouthpiece 14 after filling has been completed, from brushing against the top of a portion 3 of some product of a kind having a tendency to pile up, the suspension of the scoop 22 is embodied in the exemplary embodiment of FIGS. 3 and 4 such that the scoop 22, which dips into the container 1, is first moved upward, rotating only slightly, and is only then displaced so that it is underneath the filler mouthpiece 14.

In the following description of the exemplary embodiment of FIGS. 3 and 4, the same terms and the same reference numerals are used as in the first exemplary embodiment of FIGS. 1 and 2 if the elements are identical. The scoop 22 is carried by an articulated arm comprising two crank members 41, 42 connected to one another in articulated fashion. The lower crank 41 supports the scoop 22 in a manner similar to that of the crank 30 in the exemplary embodiment of FIGS. 1 and 2, and the upper crank 42 is supported on the fixed protrusion 29. The lower lever 41 carried a roller 44, which is drawn by the action of a tension spring 43 engaging both crank members 41, 42 toward an oblique control face 45 of a sliding block 46 which is horizontally displaceable by the actuation cylinder 39. A pin 48 of a connecting rod 49 engages a horizontal slot 47 of the sliding block 46, and the connecting rod 49 is articulated to an arm 50, extending at an angle below the pivoting axis, of the upper crank 42. A protrusion 51 on the upper crank 42 protrudes toward the lower lever 41 and has a stop face 52 for the lower crank 41. In order to compensate for relaxation on the part of the flexible belt 33, one of its ends is connected via a tension spring 53 with one of the fixed elements 28.

Once the filling process is completed, when the valve push rod 15 is retracted into the filler mouthpiece 14, the actuation cylinder 39 displaces the sliding block 46 in the direction of the cranks 41, 42. The control face 45 of the sliding block 46 which is thereby displaced causes the lower crank 41, with the scoop 22, to pivot upward under the influence of the tension spring 43, until the crank 41 strikes against the stop face 52 of the upper crank 42. Any drips suspended from the drip edge 25 of the scoop 22 then drop off and fall into the container 1. During this first movement phase, in which the scoop 22 substantially maintains its vertical position, the pin 48 of the connecting rod 49 slides in the slot 47 of the sliding block 46. As the sliding block 46 continues to move, the right-hand end of the slot 47 presses against the pin 48, so that the connecting rod 49 is carried along as well in the direction of movement of the sliding block. The upper crank 42 is thereby pivoted toward the filler mouthpiece 14, and in this movement phase the scoop 22 is displaced to underneath the filler mouthpiece 14 and rotates out of the vertical position into the horizontal position as a result of the thereby lengthening right-hand segment 35 of the belt 33 (FIG. 4).

Experience has shown that soiling of the sealing rims of containers by drips or from squirting can be prevented, in the case of a filler mouthpiece having a lateral outlet, with a scoop which passes only partway beneath the filler mouthpiece. Naturally it is also possible within the scope of the invention to embody the scoop and its supporting apparatus in such a way that with a filler mouthpiece which pours vertically downward, the scoop assumes a position entirely underneath the filler mouthpiece. The disposition of two cooperating scoops, which are moved toward one another, is also conceivable. Such an embodiment would be advantageous in the case of a filling apparatus in which the valve push rod has two outlets diverging from one another.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A filling apparatus for viscous products, said apparatus including a filler mouthpiece, a valve push rod operative in said mouthpiece to dispense a product from said filler mouthpiece, a squirt interceptor-droplet receiving element disposed relative to said filler mouthpiece, said receiving element being formed as a scoop member, said scoop member being movable relative to said filler mouthpiece to assume a substantially vertical first position at which position said scoop prevents squirting of products dispensed from said valve push rod and said scoop member being movable from said first position to a second, substantially transverse position relative to said mouthpiece in which said scoop passes below said filler mouthpiece to catch any droplets which may drop from said filler mouthpiece and said valve push rod has a lateral outlet directed toward said scoop.

2. An apparatus as defined by claim 1 in which said scoop has side portions and said side portions further include panels.

3. An apparatus as defined by claim 2 in which said scoop further includes a front edge which is wedge-shaped.

4. An apparatus as defined by claim 3, in which said front edge of said scoop is convex.

5. An apparatus as defined by claim 1 in which said scoop is rotatably supported on pivotable crank means, said crank means being connected with a mechanism for generating a one-quarter rotation upon the pivoting of said crank means.

6. An apparatus as defined by claim 5, characterized in that said scoop is provided with a protuberance arranged to support a roller, said roller further provided with a belt having divergent end portions, said end portions being fastened in a stationary manner.

7. An apparatus as defined by claim 5, in which said apparatus further includes articulated crank means, said crank means being actuated by a common drive means via transmission elements, whereby when a first of said crank means directly supporting said scoop pivots upward, a second of said crank means which supports said first crank means is pivoted in order to displace the lifted scoop to a position underneath said filler mouthpiece.

8. An apparatus as defined by claim 6 in which said apparatus further includes articulated crank means, said crank means being actuated by a common drive means via transmission elements, whereby when a first of said crank means directly supporting said scoop pivots upward, a second of said crank means which supports said first crank means is pivoted in order to displace the lifted scoop to a position underneath said filler mouthpiece.

* * * * *